US011465063B2

(12) United States Patent
Hunter et al.

(10) Patent No.: US 11,465,063 B2
(45) Date of Patent: Oct. 11, 2022

(54) SYSTEM AND METHOD FOR AFFECTING MOTION OF AN AMUSEMENT RIDE VEHICLE

(71) Applicant: PROSLIDE TECHNOLOGY INC., Ottawa (CA)

(72) Inventors: Richard Douglas Hunter, Ottawa (CA); Raymond Thomas Smegal, Ottawa (CA)

(73) Assignee: PROSLIDE TECHNOLOGY INC., Ottawa (CA)

( * ) Notice: Subject to any disclaimer, the term of this patent is extended or adjusted under 35 U.S.C. 154(b) by 508 days.

(21) Appl. No.: 16/348,983

(22) PCT Filed: Nov. 10, 2017

(86) PCT No.: PCT/CA2017/051345
§ 371 (c)(1),
(2) Date: May 10, 2019

(87) PCT Pub. No.: WO2018/085938
PCT Pub. Date: May 17, 2018

(65) Prior Publication Data

US 2019/0299111 A1 Oct. 3, 2019

Related U.S. Application Data

(60) Provisional application No. 62/420,967, filed on Nov. 11, 2016.

(51) Int. Cl.
*A63G 21/18* (2006.01)
*A63G 3/02* (2006.01)
(Continued)

(52) U.S. Cl.
CPC ..... *A63G 21/18* (2013.01); *A63G 3/00* (2013.01); *A63G 3/02* (2013.01); *A63G 21/02* (2013.01); *A63G 21/12* (2013.01); *B05B 7/2491* (2013.01)

(58) Field of Classification Search
CPC ..... A63G 21/00; A63G 21/18; A63G 3/00; A63G 3/02; A63G 21/02
(Continued)

(56) References Cited

U.S. PATENT DOCUMENTS 5,213,547 A * 5/1993 Lochtefeld ..... E04H 4/0006 472/117
5,540,622 A * 7/1996 Gold ..... A63G 21/18 472/117
(Continued)

FOREIGN PATENT DOCUMENTS

CA 2 946 045 10/2015

OTHER PUBLICATIONS

The Written Opinion of the International Searching Authority dated Feb. 1, 2018, issued by the Canadian Intellectual Property Office in International Application No. PCT/CA2017/051345 (5 pages).
(Continued)

*Primary Examiner* — Kien T Nguyen
(74) *Attorney, Agent, or Firm* — Finnegan, Henderson, Farabow, Garrett & Dunner, LLP

(57) ABSTRACT

A system for affecting motion of an amusement ride vehicle is disclosed. The system includes a channel and a plurality of fluid spray sources positioned to spray at least a primary fluid over the channel. For at least one of the fluid spray sources, the system is adapted to inject a secondary fluid into the primary fluid to modify at least one of a pressure and a velocity of the primary fluid. A corresponding method is also disclosed.

26 Claims, 13 Drawing Sheets

(51) Int. Cl.

| | |
|---|---|
| ***A63G 21/02*** | (2006.01) |
| ***A63G 21/12*** | (2006.01) |
| ***B05B 7/24*** | (2006.01) |
| ***A63G 3/00*** | (2006.01) |

(58) Field of Classification Search
USPC ..... 472/13, 117, 128, 129
See application file for complete search history.

(56) References Cited

U.S. PATENT DOCUMENTS

| | | | | |
|---|---|---|---|---|
| 7,073,734 | B2 | 7/2006 | Dorendorf et al. | |
| 2016/0136527 | A1* | 5/2016 | Hunter | A63G 21/18 472/88 |
| 2016/0288001 | A1* | 10/2016 | Johnson | A63G 21/18 |

OTHER PUBLICATIONS

International Search Report dated Feb. 1, 2018, issued by the Canadian Intellectual Property Office in International Application No. PCT/CA2017/051345 (3 pages).

* cited by examiner

SYSTEM AND METHOD FOR AFFECTING MOTION OF AN AMUSEMENT RIDE VEHICLE

CROSS-REFERENCE TO RELATED APPLICATION

This application claims the benefit of U.S. Provisional Patent Application No. 62/420,967 entitled "System and Method for Affecting Motion of an Amusement Ride Vehicle" filed Nov. 11, 2016, the entire content of which is incorporated herein by reference.

FIELD OF THE INVENTION

This invention relates generally to amusement rides and, in particular, to water rides where participants ride in or on vehicles.

BACKGROUND

In the past few decades, amusement rides have become increasingly popular. Some amusement rides are configured as a slide where a fluid, such as water, is used to lubricate the sliding surface. A common type of this amusement ride is a flume-style slide in which one or more participants ride in a vehicle which slides along a channel or "flume" over the lubricated surface from the start of the slide to the end of the slide.

The fluid, typically water, is provided in the flume to provide lubrication between the vehicle and the flume surface, and to provide cooling and splashing effects. In particular, rides using water are very popular. In hot climates, the cooling effects of water allow participants to enjoy the outdoors when temperatures would otherwise make the outdoor experience unpleasant.

Nonetheless, fluid lubricated amusement rides often require large volumes of fluid to operate and utilize significant energy reserves to move the fluid throughout the ride.

Furthermore, a desire for increasingly thrilling amusement rides may increase the demand for the fluid and may increase the requirements for the associated infrastructure, such as motors, pumps, and piping, etc., which may be costly.

SUMMARY

In one aspect of the disclosure, there is provided a system for affecting motion of an amusement ride vehicle. The system comprises a channel within which the vehicle travels and a plurality of fluid spray sources positioned to spray at least a primary fluid into the channel. For at least one of the fluid spray sources, the system is adapted to inject a secondary fluid into the primary fluid to modify at least one of a pressure and a velocity of the primary fluid.

In some embodiments, one or both of the primary fluid and the secondary fluid is a liquid, a gas, or a combination thereof.

In some embodiments, the primary fluid is water and the secondary fluid is air.

In some embodiments, the system further comprises an air dryer to supply dry air as the secondary fluid.

In some embodiments, the system further comprises an air compressor to supply pressurized air as the secondary fluid.

In some embodiments, the at least one fluid spray source includes a nozzle having a primary fluid inlet and a primary fluid outlet, the nozzle being adapted to have the secondary fluid injected between the primary fluid inlet and the primary fluid outlet.

In some embodiments, the system further comprises a Venturi tube upstream of the at least one fluid spray source, the Venturi tube being adapted to have the secondary fluid injected in a constriction portion of the Venturi tube.

In some embodiments, the system further comprises a first sensor adapted to detect when the vehicle enters a zone of the channel; at least one valve associated with injecting the secondary fluid; and a controller in communication with the first sensor and the at least one valve, the controller being adapted to selectively open the at least one valve and permit injection of the secondary fluid in response to the vehicle entering the zone.

In some embodiments, the system further comprises a second sensor adapted to detect when the vehicle exits the zone of the channel, the controller being in communication with the second sensor and being adapted to close the at least one valve to cease injection of the secondary fluid in response to the vehicle exiting the zone.

In some embodiments, the channel is upwardly angled and a flow from the plurality of fluid spray sources has a force sufficient to boost the vehicle up the channel.

In some embodiments, the channel is horizontal and a flow from the plurality of fluid spray sources has a force sufficient to accelerate the vehicle along the channel.

In some embodiments, the flow exiting the at least one fluid spray source comprises a mixture of liquid and gas.

In some embodiments, the system is adapted to inject secondary fluid for at least one pair of fluid spray sources, each of the fluid spray sources in the at least one pair being positioned on opposite sides of the channel.

In some embodiments, the system further comprises at least one manifold for supplying primary fluid to the plurality of fluid spray sources, the manifold comprising at least one primary fluid inlet and a respective primary fluid outlet for each of the of the plurality of fluid spray sources.

In some embodiments, the system is adapted to inject the secondary fluid between at least one of the primary fluid outlets and the corresponding fluid spray source.

In some embodiments, the secondary fluid is injected at a predetermined injection pressure that is higher than the pressure of the primary fluid.

In some embodiments, the injection pressure is between 40 and 70 psi.

In some embodiments, a volumetric flow rate of the primary fluid through each of the plurality of fluid spray sources is between 33 and 36 US gallons per minute.

In another aspect of the disclosure, there is provided a method of affecting motion of an amusement ride vehicle. The method comprises providing a channel within which the vehicle travels; positioning a plurality of fluid spray sources to spray at least a primary fluid into the channel; injecting a secondary fluid into the primary fluid flowing through at least one of the plurality of fluid spray sources to modify at least one of a pressure and a velocity of the primary fluid so that a mixture of the primary and secondary fluids is sprayed with a force sufficient to affect the motion of the vehicle.

In some embodiments, one or both of the primary fluid and the secondary fluid is a liquid, a gas or a combination thereof.

In some embodiments, the primary fluid is water and the secondary fluid is air.

In some embodiments, the method further comprises pressurizing the air before injecting the air.

In some embodiments, the method further comprises drying the air before injecting the air.

In some embodiments, the method further comprises sensing when the vehicle is entering a zone of the channel before injecting the secondary fluid and injecting the secondary fluid in response to the vehicle entering the zone.

In some embodiments, the method further comprises sensing when the vehicle is exiting the zone and ceasing injection of the secondary fluid in response to the vehicle exiting the zone.

In some embodiments, the channel is upwardly angled and a force of a flow from the plurality of fluid spray sources boosts the vehicle up the channel.

In some embodiments, the channel is horizontal and a force of a flow from the plurality of fluid spray sources accelerates the vehicle along the channel.

In some embodiments, injecting the secondary fluid comprises injecting the secondary fluid at a nozzle of the at least one fluid spray source.

In some embodiments, injecting the secondary fluid comprises injecting the secondary fluid at a constriction of a Venturi tube positioned upstream of the at least one fluid spray source.

In some embodiments, injecting the secondary fluid comprises injecting the secondary fluid for at least one pair of fluid spray sources, wherein each fluid spray source in the at least one pair is positioned on opposite sides of the channel.

In some embodiments, the method further comprises providing at least one manifold for supplying primary fluid to the plurality of fluid spray sources, the manifold comprising at least one primary fluid inlet and a respective primary fluid outlet for each of the plurality of fluid spray sources.

In some embodiments, injecting the secondary fluid comprises injecting the secondary fluid between at least one of the primary fluid outlets and the corresponding fluid spray source.

In some embodiments, injecting the secondary fluid comprises injecting the secondary fluid at a predetermined injection pressure that is higher than the pressure of the primary fluid.

In some embodiments, the injection pressure is between 40 and 70 psi.

In some embodiments, a volumetric flow rate of the primary fluid through each of the plurality of fluid spray sources is between 33 and 36 US gallons per minute.

Other aspects and features of embodiments of the present disclosure will become apparent to those ordinarily skilled in the art upon review of the following description.

BRIEF DESCRIPTION OF THE DRAWINGS

Examples of embodiments of the invention will now be described in greater detail with reference to the accompanying drawings, in which.

DETAILED DESCRIPTION

A system for affecting motion of an amusement ride vehicle may include a channel within which the vehicle travels and a plurality of fluid spray sources positioned to spray at least a primary fluid into the channel. For at least one of the fluid spray sources, the system may be adapted to inject a secondary fluid into the primary fluid to modify at least one of a pressure and a velocity of the primary fluid.

A method of affecting motion of an amusement ride may include providing a channel within which the vehicle travels, positioning a plurality of fluid spray sources to spray at least a primary fluid into the channel, and injecting a secondary fluid into the primary fluid flowing through at least one of the plurality of fluid spray sources to modify at least one of a pressure and a velocity of the primary fluid so that a mixture of the primary and secondary fluids is sprayed with a force sufficient to affect the motion of the vehicle.

Figure 1:
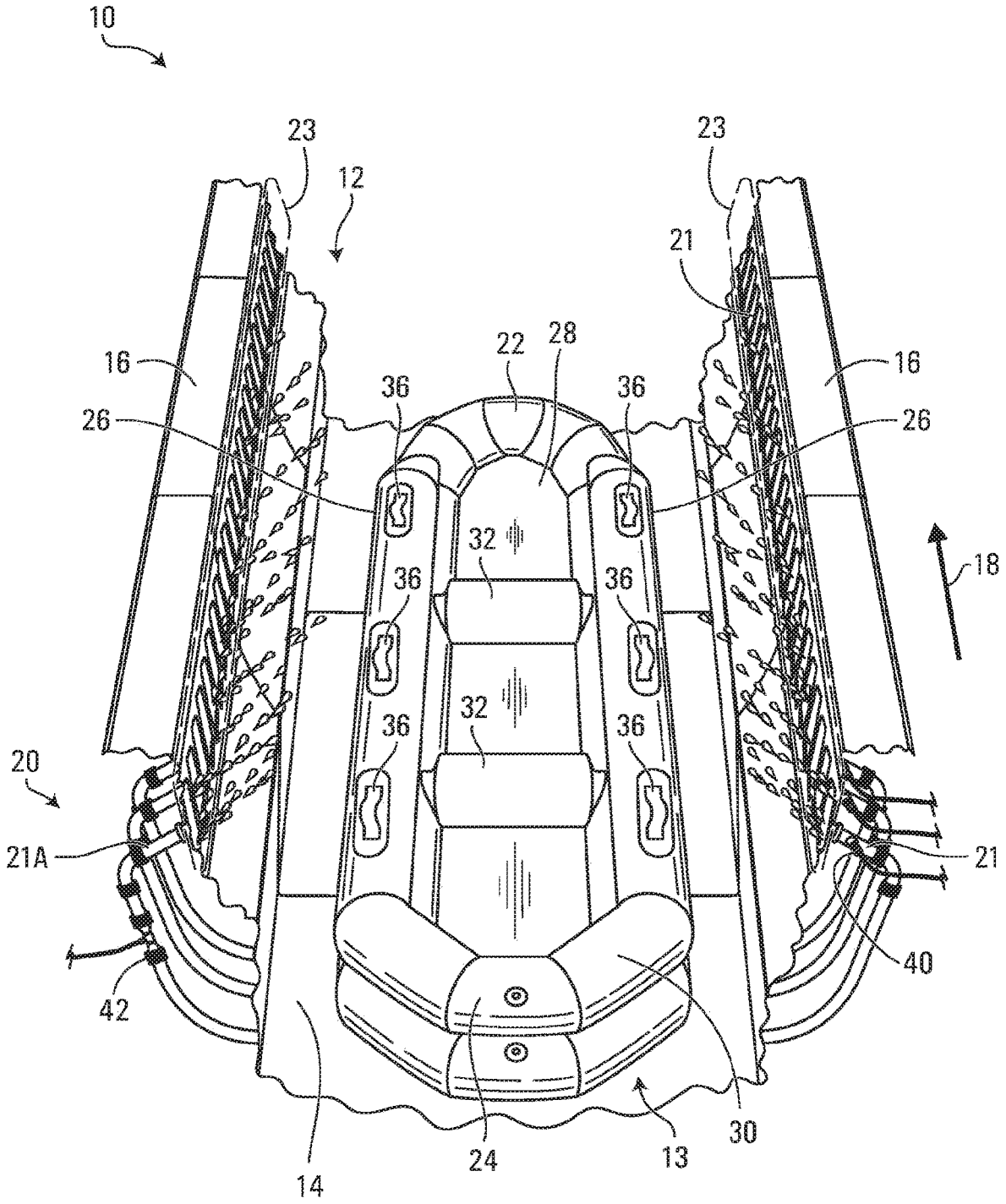
FIG. 1 is a schematic top view of a portion of a system for affecting motion of an amusement ride vehicle according to an embodiment.

FIG. 1 shows a first embodiment of an amusement ride motion control system 10. The system 10 includes a channel 12 and a vehicle 13. Only a portion of the channel 12 is depicted in FIG. 1. The channel 12 may comprise a flume style slide having a central sliding surface 14 between side walls 16. The sliding surface may be lubricated with a primary fluid, such as water, as in a traditional flume ride, or may have a low friction coating. The channel 12 may alternatively be a channel filled with primary fluid, such as water, in which there is sufficient fluid that the vehicle 13 may float or the vehicle may include wheels and may roll or otherwise move. The walls 16 may be closely adjacent the path of the vehicle 13 on sliding surface 14 to assist in guiding the vehicle along a predetermined path, or spaced further away from an indeterminate path of the vehicle 13.

A direction of travel of the vehicle 13 along the channel 12 is indicated by the arrow 18.

Spaced along the walls 16 are primary fluid injectors or fluid spray sources 20, which may be positioned within recesses 23. In this embodiment, the spray sources 20 are depicted laterally aligned with each other in pairs along the walls 16. In other embodiments, more or fewer spray sources 20 may be provided. In this embodiment, the primary fluid sprayed from the spray sources is water. In other embodiments, the primary fluid may be something other than water and may be a different incompressible liquid or a mixture of liquids. In yet other embodiments, the primary fluid may be a compressible gas, such as air, nitrogen, or a mixture of gases.

In yet further embodiments, the primary fluid may be a solid/liquid suspension or combinations of a liquid and a gas. In some embodiments the spray sources 20 spray horizontally; in other embodiments, the spray sources 20 may spray at an upward or downward angle. In some embodiments, the spray sources 20 may be narrowly focused to provide a jet of fluid or mixture of fluids; in other embodiments, the spray may be less focused.

In the present embodiment, the spray sources 20 are configured and arranged to direct at least the primary fluid towards the direction of travel of the vehicle 13 to affect motion of the vehicle 13. Specifically, as shown, the spray sources 20 are angled to spray fluid with respect to the vehicle 13 in a manner that affects motion of the vehicle 13.

Other arrangements, positioning, and angling of the fluid spray sources 20 are also possible. In some embodiments, a single spray source may be located at one end of the channel 12 or on a different portion or section of the amusement ride. In some embodiments, fluid spray sources may be arranged along, in or on the central sliding surface 14.

The spray sources may alternatively be perpendicular to the direction of travel, for example, to spin a round vehicle, or angled in a reverse direction, for example, to slow the velocity of the vehicle 13.

In some embodiments, the spray sources 20 include a spray nozzle 21 positioned at an end of the spray source and primary fluid is pressurized or pumped out through the spray nozzle 21. In this embodiment, the pressure of the spray may be about 30-60 psi and the fluid flow rate may be about 25-55 US Gallons Per Minute (USGPM) per nozzle. However, the exact pressure, volume and spray or jet pattern, whether narrowly focused or expansive, will be determined based on the requirements of the particular system and other factors. Additionally, the spray sources 20 may vary from each other and may be controllable with regards to pressure, volume, spray pattern and direction.

Figure 1A:
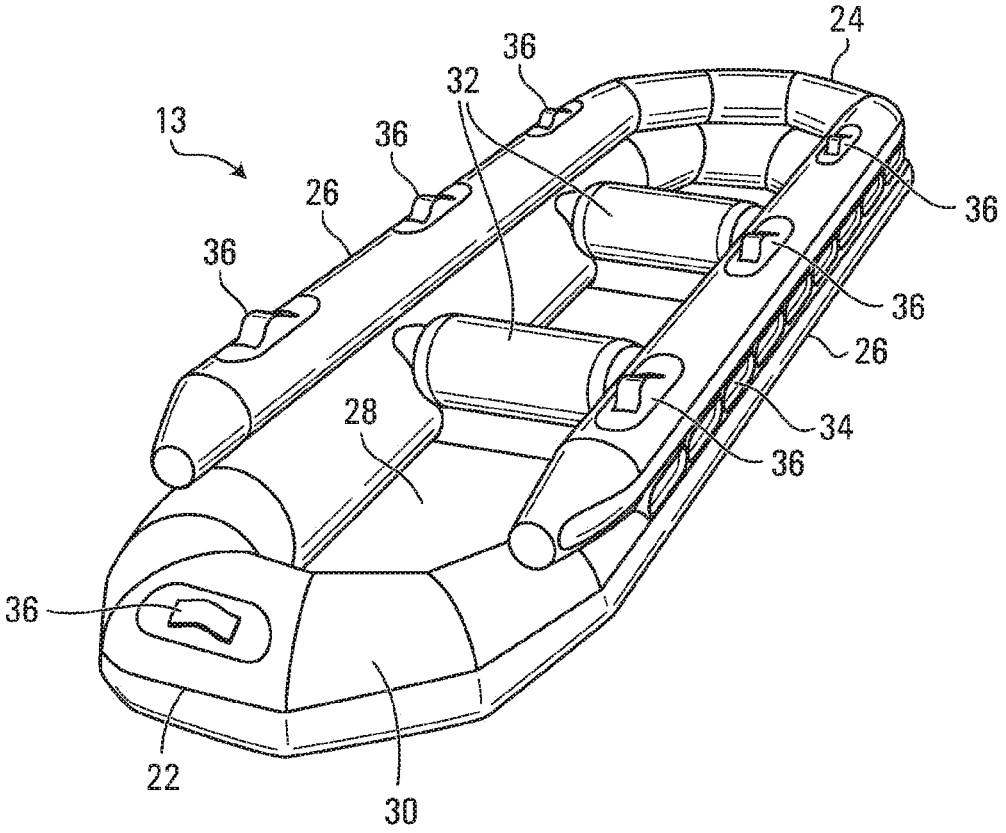
FIG. 1A is a perspective view of one embodiment of a vehicle for use with the system of FIG. 1.

Referring to FIGS. 1 and 1A, the vehicle 13 of this embodiment is a raft type vehicle with a front end 22, a rear end 24, sides 26, and a bottom 28 and may be adapted to have its motion affected by a flow from the plurality of fluid spray sources 20. The vehicle 13 has a roughly elongated oval shaped body. An inflated tube 30 extends around the perimeter of the body of vehicle 13 and defines the front end 22, rear end 24 and sides 26. The bottom 28 connects to the bottom surface (not shown) of the inflated tube 30 to define an interior of the vehicle 13 for carrying passengers. In this embodiment, the vehicle 13 also includes two center partitions 32. However, more or fewer partitions may be included. In some embodiments, the vehicle 13 has no partitions. The vehicle 13 may accommodate three riders, one in front, one in between and one behind the partitions 32. It will be understood that the vehicle 13 is merely exemplary and other embodiments may be possible.

Some embodiments of vehicle 13 that may be suitable for use in system 10 are described, for example, in PCT Application No. PCT/CA2015/050339, which is hereby incorporated herein by reference in its entirety. One or more components of the system 10, as well as the vehicle 13, may also be the same as one or more components described in PCT Application No. PCT/CA2016/050838, which is also hereby incorporated herein by reference in its entirety.

In the embodiment of FIGS. 1 and 1A, the sides 26 are defined by the inflated tube 30. The inflated tube 30 may have a circular cross section such that the outer side walls of the vehicle 13 are curved. A series of recesses or intakes 34 may be defined into the sides 26. In this embodiment, nine recesses are spaced substantially equally along a portion of the sides 26 of the vehicle 13. In other embodiments there may be more or fewer pairs of recesses, based on system requirements. The recesses 34 are angled in the direction of travel of the vehicle 13. The angle of the recesses 34 is configured such that, when spray from the spray sources 20 is aligned with one of the recesses 34, the primary fluid sprays directly into the respective recesses 34 and impacts against an interior or impact surface (not visible), thus acting on the vehicle 13 and affecting its motion.

The vehicle 13 may also include handles 36 to allow riders to hold on to during a ride or to allow someone to grip the vehicle and move it, for example if the vehicle is taken out of or placed into the ride.

In some embodiments, the vehicle 13 may be configured differently. For example, it may have a different shape without the handles 36 or any recesses 34 at all. In some embodiments, the vehicle 13 may consist of a simple tube, such as an annular tube, without recesses and/or without a bottom. A wide array of vehicles may be used with the system 10 and have their motion affected by the force of the flow from the spray sources 20.

It will be appreciated that the force of the spray from the spray sources 20 against the vehicle, for example against the impact surfaces in recesses 34, if present, will affect the motion of the vehicle. The force of the fluid is a function of the pressure and velocity of the primary fluid or mixture of fluids exiting the plurality of fluid spray sources 20. The force required to affect motion of the vehicle may depend on a variety of factors including one or more of a size and shape of the vehicle 13, the number of riders, the weight of the vehicle 13, a velocity of the vehicle 13, the desired length over which the vehicle should travel, the friction due to the contact between the vehicle 13 and the channel 12, and inclination of the channel 12, amongst others.

To modify or increase at least one of a pressure and a velocity of the primary fluid exiting the spray source a secondary fluid may be injected into the primary fluid. Accordingly, the force generated by the flow exiting the spray source—and thus the force acting on the vehicle—may be increased without increasing the flow rate of the primary fluid. Therefore, in some embodiments, for at least one of the fluid spray sources 20, the system is adapted to inject a secondary fluid into the primary fluid to modify or increase at least one of a pressure and a velocity of the primary fluid or of a mixture of the primary and secondary fluids. Some such embodiments will now be described in more detail with reference to FIGS. 2 and 3.

Figure 2:
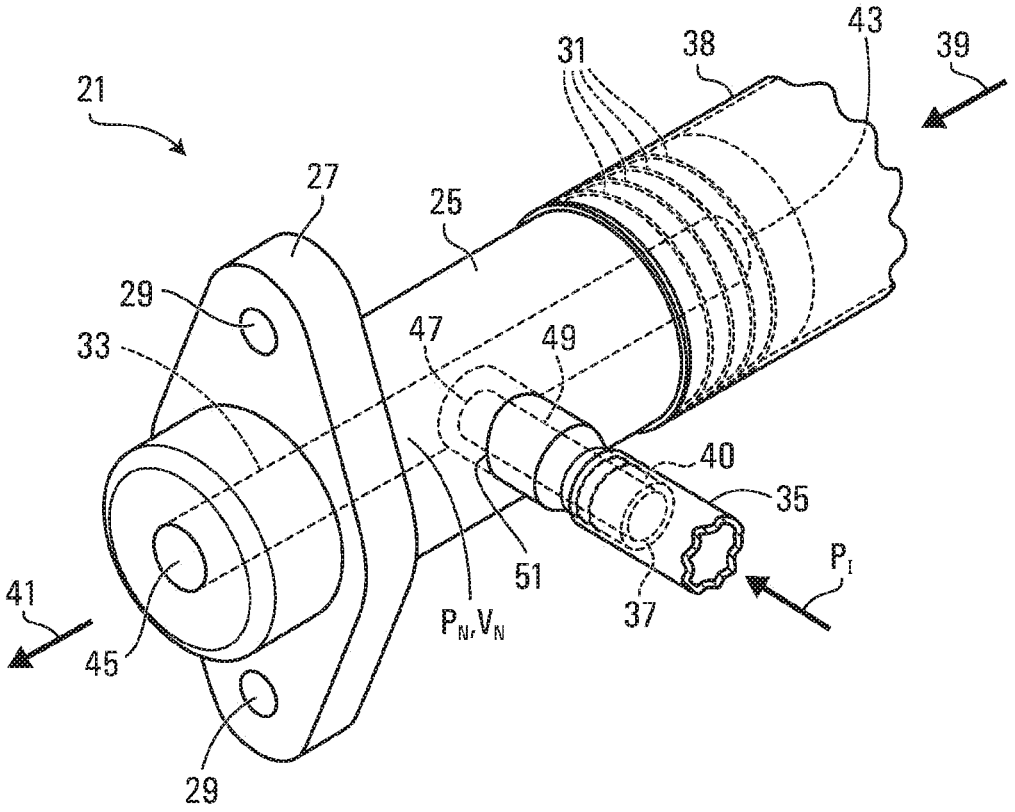
FIG. 2 is a schematic view of a first embodiment for injecting secondary fluid in the system of FIG. 1.

FIG. 2 shows a schematic view of one possible embodiment for injection of the secondary fluid. This embodiment may be utilized as part of the system 10 as shown in FIG. 1, where the nozzle 21 is present on at least three of the fluid spray sources, as seen on the right hand side of the figure. It will be understood that this is exemplary only and, as discussed herein, there are numerous different configurations and arrangements possible for the injection of the secondary fluid.

In FIG. 2, the nozzle 21 is shown inserted into a hose or tubing 38. The nozzle 21 comprises a cylindrical body 25, with a primary fluid inlet 43 and a primary fluid outlet 45. Adjacent to the outlet 45 is a collar 27. The collar 27 protrudes outward perpendicular from the cylindrical body 25 and perpendicular to the longitudinal length of the cylindrical body 25. The collar 27 has two holes 29 defined there through parallel to and on opposite sides of the cylindrical body 25. Adjacent the inlet 43 are four spaced apart ring shaped projections 31 which encircle the cylindrical body 25. These ring shaped projections 31 may help to retain the tubing 38 on the cylindrical body 25 in use.

Although a particular shape and type of a nozzle 21 is described, it will be appreciated that various other nozzle shapes and types may be employed. For example, other shapes of projections and/or depressions may be provided to assist in retaining hose or other flexible conduit to the nozzle 21, and at other locations on the nozzle 21, or may be eliminated, or replaced with threading for use with an inflexible conduit. The collar 27 may be at another location, have another shape or may be eliminated. For example, the holes 29 may be omitted and an adhesive or sealant may be used to fix the nozzle 21 in place. With the use of an adhesive or sealant around the cylindrical body 25, the collar 27 could be omitted. In some embodiments, the nozzle is formed in two parts, which may facilitate their installation and removal. Furthermore, the shape of the nozzle outlet 45 may vary as well. The outlet may flare or be conical or have a different shape.

The nozzle 21 also includes a tubular channel 33 that extends through cylindrical body 25 and connects inlets 43 and outlet 45. While the tubular channel 33 is shown as having a constant cross-sectional diameter through the cylindrical body 25, it will be appreciated that the cross-sectional diameter and/or cross-sectional shape/profile may vary along the length of the body 25.

In this embodiment, the nozzle 21 is adapted to have the secondary fluid injected between the primary fluid inlet 43, which is connected with tubing 38 and the primary fluid outlet 45 of the nozzle 21.

As shown by arrow 39, primary fluid flows from right to left through the tubing 38 into the primary fluid inlet 43, through the tubular channel 33 and out of the outlet 45 in direction of arrow 41. In the nozzle 21, the primary fluid has a nozzle pressure $P_N$ and a nozzle velocity $V_N$. The secondary fluid is injected into the primary fluid via injection fitting 40 that feeds directly into the nozzle 21 and fluidly connects a hose or tubing 35 with tubular channel 33. An injection pressure of the secondary fluid, $P_I$, is sufficiently large so as to modify or increase at least one of the nozzle pressure $P_N$ and/or the nozzle velocity $V_N$ of the primary fluid. A mixture of primary and secondary fluid then exits the nozzle 21 through the primary fluid outlet 45 in the direction of arrow 41.

The injection fitting 40 includes an inlet 37 and an outlet 47, which are connected by a tubular channel 49. The hose 35 is connected at the inlet 37 and supplies secondary fluid to the injection fitting 40. As is the case with the tubular channel 33, although the tubular channel 49 is depicted as having a constant cross-sectional diameter, the tubular channel 49 may have a varying cross-sectional diameter across the length of the injection fitting 40.

In this embodiment, the cylindrical body 25 includes an injection opening 51 into which the injection fitting 40 is installed. For example, the injection opening 51 may be drilled or formed into the cylindrical body 25 and sized so that the injection fitting 40 may be inserted and sealed in a known manner.

In some embodiments, injection opening 51 may be threaded and the injection fitting 40 may have a corresponding threaded section for screwing into the threaded injection opening 51.

In other embodiments, the cylindrical body 25 may not have an injection opening 51 and the body 25 may be formed, machined, or otherwise manufactured to have a connection protruding from its body that acts as an injection fitting 40 to which the hose 35 may be connected in a known manner, for example using one or more worm gear clamps.

In this embodiment the nozzle 21 may be formed from machined polyvinyl chloride (PVC) but, in other embodiments, may be made of any suitable material and in any suitable manner. Similarly, the injection fitting 40 may be made of a variety of suitable materials.

In some embodiments, the nozzle 21 may be adapted to have the secondary fluid injected at one or more other locations than depicted in FIG. 2. Secondary fluid may be injected at more than one location between the fluid inlet 43 and the fluid outlet 45. The injection locations may be at any distance from each other. The secondary fluid may be injected at multiple points along the flow direction of the primary fluid and/or at different angles relative to the flow of the primary fluid.

Figure 3:
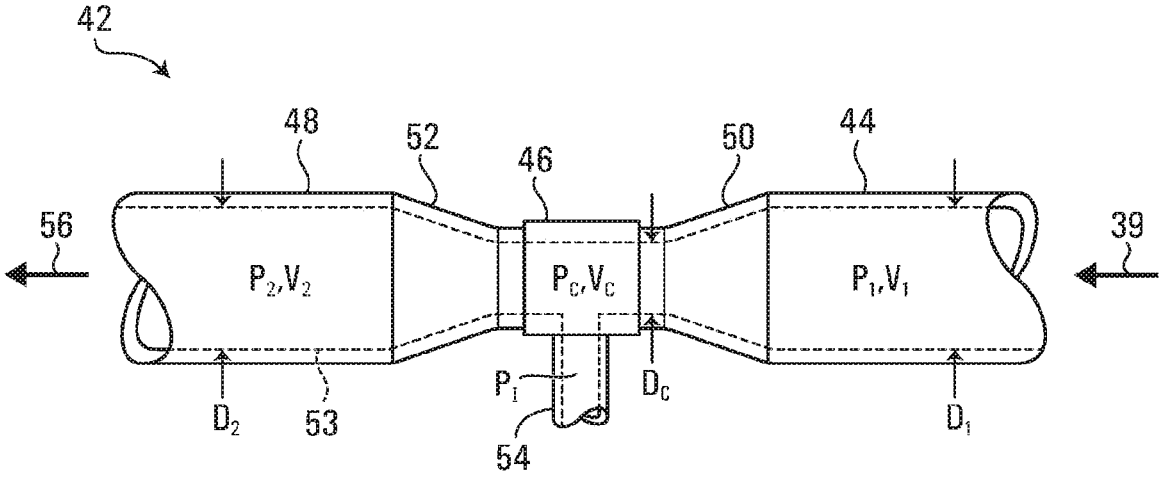
FIG. 3 is a schematic view of a second embodiment for injecting secondary fluid in the system of FIG. 1.

FIG. 3 shows a schematic view of a further possible embodiment for injection of the secondary fluid. Specifically, in this embodiment, a converging-diverging nozzle or a Venturi tube 42 upstream of one or more of the fluid spray sources 20 is adapted to have the secondary fluid injected. This embodiment may be utilized as part of the system 10 as shown in FIG. 1, where the Venturi tube 42 is present up stream of one of the fluid spray sources 20 and a nozzle 21A, as seen on the left hand side of the figure. It will be understood that this is exemplary only and, as discussed herein, there are numerous different configurations and arrangements possible for the injection of the secondary fluid.

Only a section of the Venturi tube 42 is shown in FIG. 3. It is to be understood that the Venturi tube 42 may be a separate component that is attached to tubing or lines that allow primary fluid to flow through the Venturi tube 42.

Again, the primary fluid flows from right to left through the Venturi tube 42 in the direction of arrow 39. Specifically, the primary fluid flows through inner channel 53, which has a varying cross-sectional diameter along the length of the Venturi tube 42. The Venturi tube 42 has an entrance portion 44, where the channel 53 has a first diameter $D_1$, a constriction portion 46, where the channel 53 has a constriction diameter $D_C$, and an exit portion 48, where the channel 53 has a second diameter $D_2$. First and second frustoconical transition portions 50 and 52 may provide a gradual transition from the first diameter $D_1$ to the constriction diameter $D_C$ and from the constriction diameter $D_C$ to the second diameter $D_2$, respectively. The diameters $D_1$ and $D_2$ might be equal or might be different. The constriction diameter $D_C$ is smaller than both the first and second diameters $D_1$, $D_2$.

In this embodiment, the constriction portion 46 is a separate piece to which the portions 44 and 48 are connected, for example by being screwed into the constriction portion 46. However, it is to be understood that the Venturi tube 42 may be machined, formed or otherwise manufactured of a single piece or of a different number of pieces.

As will be appreciated, at a constant flow rate, the pressure and velocity of the primary fluid changes as it flows through the Venturi tube 42. As primary fluid flows through the entrance portion 44, it has a first pressure $P_1$ and a first velocity Due to the Venturi effect, the pressure of the primary fluid drops and its velocity increases as it flows through the constriction portion 46. Thus, as the primary fluid flows through the constriction portion 46, it has a constriction pressure $P_C$ and a constriction velocity $V_C$, where $P_1>P_C$ and $V_1<V_C$. Similarly, as the diameter increases again in the exit portion 48, the pressure of the primary fluid increases again and its velocity drops. Thus, as the primary fluid flows through the exit portion 48 it has a second pressure $P_2$ and second velocity $V_2$, where $P_2>P_C$ and $V_2<V_C$.

As shown in FIG. 3, the Venturi tube 42 may be adapted such that the secondary fluid is injected via injection line 54 into the constriction portion 46. The injection pressure $P_I$ is sufficiently large so as to increase the constriction pressure $P_C$ of the primary fluid.

A mixture of primary and secondary fluid then exits the exit portion 48 in the direction of arrow 56 and continues on to a fluid spray source, such as the nozzle 21.

Although not shown, the injection line 54 may also be connected to hose or tubing, such as hose 35, that supplies secondary fluid. Furthermore, injection line 54 may be an injection fitting, such as the injection fitting 40 described in respect of FIG. 2, that fluidly connects hose 35 to the flow of primary fluid in the channel 53. Such an injection fitting may be screwed into or otherwise connected to the constriction portion 46 in a known manner. In some embodiments, the constriction portion 46 is formed, machined or otherwise manufactured to have an injection fitting protruding therefrom to which a hose may be connected. Similarly, if the Venturi tube is machined, formed or otherwise manufactured as a whole, it may have an injection fitting protruding therefrom.

In some embodiments, the Venturi tube 42 may be adapted to have the secondary fluid injected at one or more other locations than depicted in FIG. 3. Secondary fluid may be injected at more than one location along the length of the Venturi tube 42. The injection locations may be at any distance from each other. The secondary fluid may be injected at multiple points along the flow direction of the primary fluid and/or at different angles relative to the flow of the primary fluid.

Furthermore, although the Venturi tube 42 is shown in FIG. 3 as only having one constriction portion, there may be additional constriction portions spaced apart by portions with a diameter larger than the adjacent constriction portions. If multiple constriction portions are present, secondary fluid may be injected into one or more of them. Furthermore, the multiple constriction portions may have the same or different diameters and the portions in-between the constriction portions may have the same or different diameters from each other.

It will also be appreciated that the Venturi tube may have different cross-sectional shapes/profiles than those depicted, which may vary over the length of the tube.

In some embodiments, the secondary fluid may be injected using a T-fitting, or other suitable plumbing fitting. Due to a natural constriction that occurs in plumbing fittings, the same principles as outlined above regarding the Venturi tube 42 may apply similarly to a plumbing fitting.

In some embodiments, secondary fluid may simply be injected into the primary fluid without the primary fluid flowing through a constriction at the point of injection.

In the above described embodiments, by injecting the secondary fluid into the primary fluid, it may be possible to obtain a flow with a force sufficient to affect motion of the vehicle 13, albeit with a lower volumetric flow rate of the primary fluid than would have been necessary to produce the same amount of force if the secondary fluid had not been injected.

While two embodiments of injecting the secondary fluid have been described, other embodiments may also be possible.

The secondary fluid may be injected at other points in the system for providing the primary fluid. For example, the secondary fluid may be injected in a constriction portion of a Venturi tube upstream of the fluid spray source 20, as well as in the nozzle 21. The secondary fluid may also be injected at one or more other points in the system, such as into the tubing, piping or other components upstream of the spray sources 20.

Furthermore, it will be understood that, while only one injection line was described in respect of each embodiment, there may be additional injection lines for injecting secondary fluid at multiple locations. For example, there may be two or more injection lines 40 leading into the nozzle 21 or two or more injection lines 54 leading into the constriction portion 46. Secondary fluid may also be injected into the entry portion 44 and/or the exit portion 48 of the Venturi tube 42.

Injection of the secondary fluid may occur for one or more of the fluid spray sources. In some embodiments, secondary fluid may be injected into the primary fluid for some pairs of the fluid spray sources, but not others. In some embodiments, there may be one or more banks or sets of fluid spray sources for which secondary fluid is injected adjacent to one or more banks or sets for which secondary fluid is not injected. Injection may also occur only for every second fluid spray source in a bank or every third fluid spray source, etc. Other embodiments are also possible.

Moreover, it is noted that the secondary fluid may be a liquid, i.e. a incompressible fluid, or a gas, i.e. a compressible fluid. Thus, one or both of the primary fluid and the secondary fluid may be a liquid, a gas, or a combination thereof.

Figure 4:
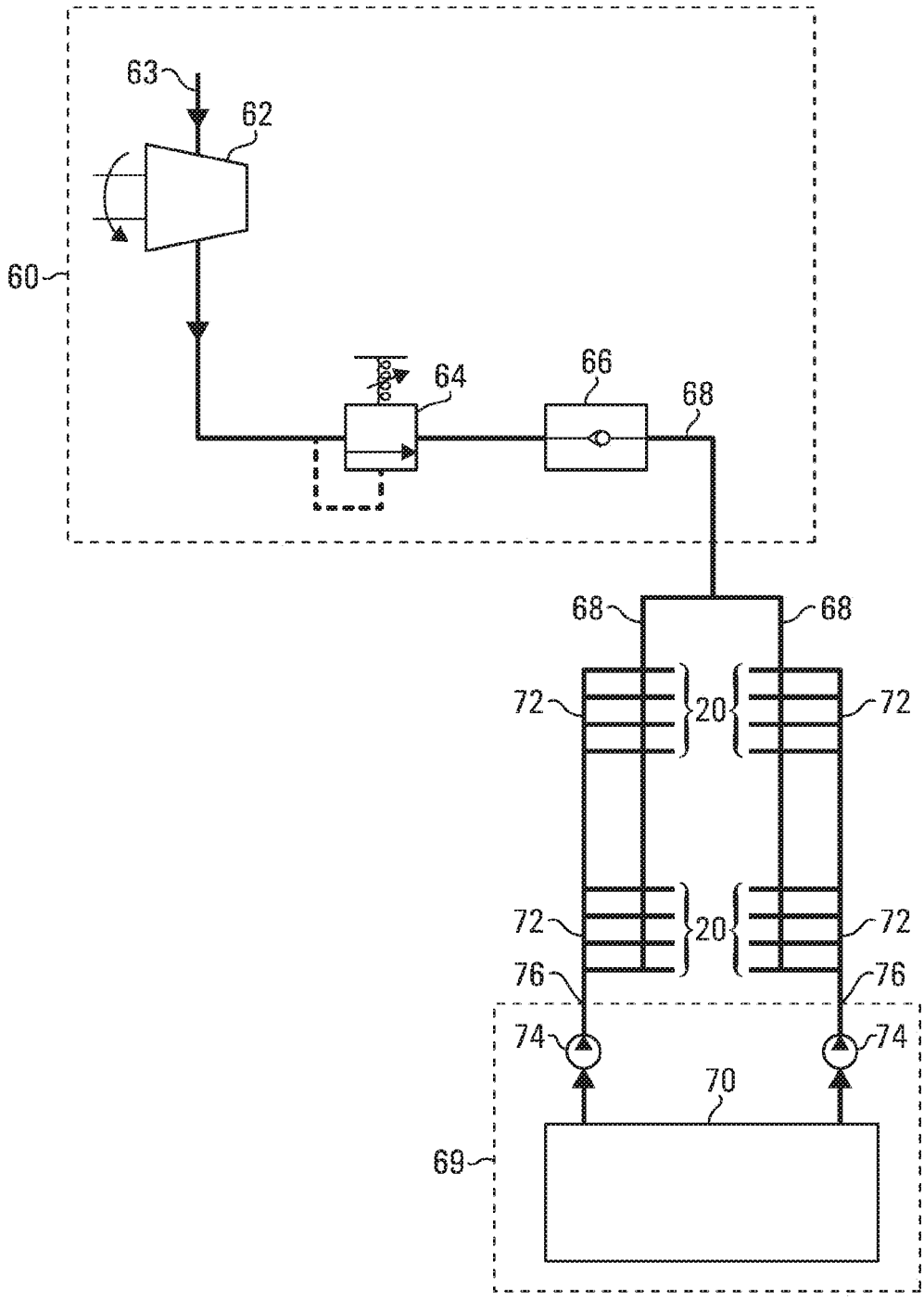
FIG. 4 is a schematic view of primary fluid and secondary fluid supply systems for supplying primary and secondary fluid to the system of FIG. 1.

FIG. 4 shows a schematic of mechanical systems used to supply primary and secondary fluids to the system 10. In the embodiment shown, secondary fluid supply system 60 includes a compressor 62, a pressure regulator 64, a one-way valve 66 and a secondary fluid feed line 68 that feeds secondary fluid between the components of system 60 and feeds secondary fluid to spots where it interfaces with a primary fluid supply system 69 and is injected.

In this embodiment, the compressor 62 compresses and thereby pressurizes the secondary fluid, such as air, which is provided by an intake 63. The pressure regulator 64, such as a pressure valve, is used to maintain the pressure of the secondary fluid at a desired value or within a desired range. The one-way valve 66, such as a check valve, prevents back flow and may be controlled to selectively permit and cease injection of the secondary fluid.

One or more of the components of the system 60, such as the one-way valve 66, may be operably connected to a programmable logic controller (PLC), which controls the components.

As shown in FIG. 4, the primary fluid supply system 69 includes a supply of the primary fluid, such as water, maintained in a surge tank 70. From the surge tank 70, the primary fluid is pumped to one or more manifolds 72 using one or more pumps 74 via one or more primary fluid feed lines 76.

The manifolds 72 in turn distributes the primary fluid to the plurality of fluid spray sources 20. As shown schematically, the secondary fluid feed line 68 meets with and feeds secondary fluid into the primary fluid feed line 76 at multiple fluid spray sources shortly before the flow exits the fluid spray sources.

Additional components, which are not shown in FIG. 4 may be included in the primary fluid supply system 69. For example, one or more valves used to control the flow of the primary fluid to various portions of the amusement ride may be provided. A control system for control of the primary fluid supply system may be included. The primary fluid supply system 69 may include some or all of the components and configurations discussed in the above-mentioned PCT Application Nos. PCT/CA2015/050339 and PCT/CA2016/050838, such as drains, valves, controllers, sensors, etc.

The supply systems 60 and 69 have been described assuming that the primary fluid is an incompressible fluid, such as water, and the secondary fluid is a compressible fluid, such as a gas, for example air. It will be understood that, in embodiments where the primary fluid is a compressible fluid and the secondary fluid is an incompressible fluid, components of the supply systems 60 and 69 would be switched, supplemented or omitted as necessary and desired to accommodate the fluids being used as the primary and secondary fluids. For example, a compressor may be provided to compress the primary fluid if the primary fluid is compressible and a pump may be provided to pump the secondary fluid if it is incompressible. Similarly, if both the primary and secondary fluids are compressible or they are both incompressible, there may be additional or different components in the supply systems 60 and 69. For example, one or more compressors or one or more pumps may be provided for each of the primary and secondary fluids.

Figure 5A:
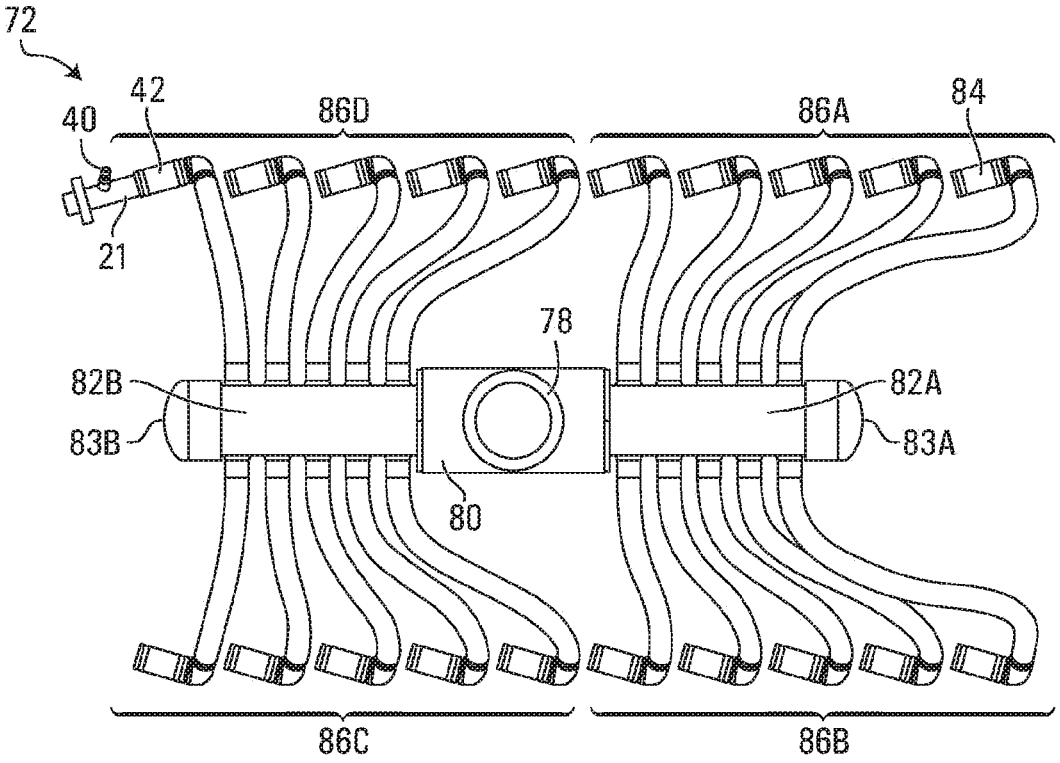
FIG. 5A is a bottom view of one embodiment of a manifold for distributing primary fluid to the system of FIG. 1.
Figure 5B:
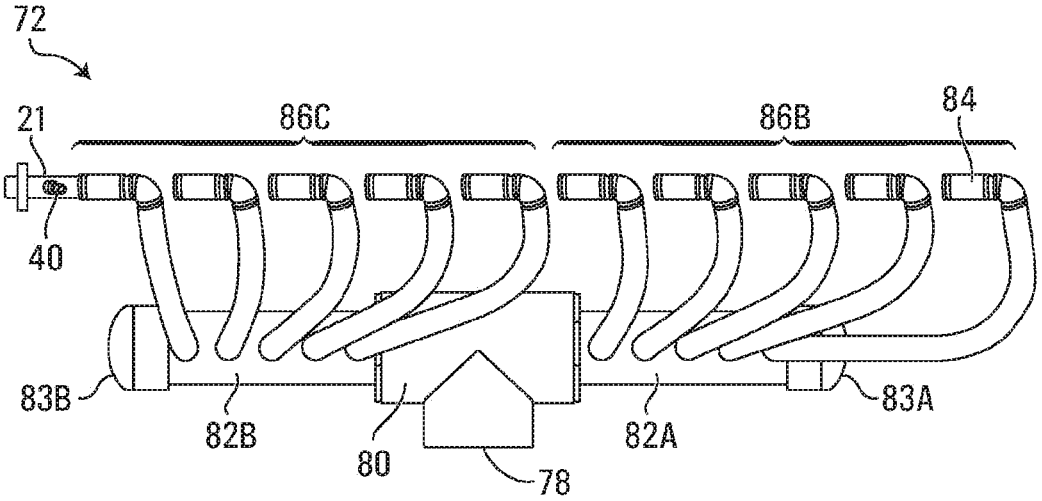
FIG. 5B is a side view of the manifold of FIG. 5A.

Referring now to FIGS. 5A and 5B, one embodiment of the manifold 72 will be described in more detail. In this embodiment, the manifold 72 includes a primary fluid inlet 78, through which the primary fluid flows into a T-shaped body 80. The fluid inlet 78 may be connected to a primary fluid supply pipe or other tubing (not shown) for supplying primary fluid.

Opposing arms 82A and 82B extend from the body 80. The arms 82A, 82B are capped off at their ends with caps 83A and 83B, respectively. A plurality of primary fluid outlets 84 arranged in rows 86A, 86B, 86C and 86D. Rows 86A and 86B form a first pair and are located on opposite sides of arm 82A. Rows 86C and 86D form a second pair and are located on opposite sides of arm 82B.

The outlets 84 then feed directly into fluid spray sources 20, such as the nozzle 21, which is shown connected to one outlet 84 in FIGS. 5A and 5B, for spraying fluid onto the channel 12.

In the embodiment shown, there are five outlets in each row, totalling twenty outlets. Each respective outlet 84 supplies a corresponding one of the plurality of fluid spray sources 20. However it is to be understood that in other embodiments there may be a different number of outlets 84 supplying a different number of fluid spray sources.

Furthermore, the manifold 72 may have more than one inlet and may take on different shapes and configurations. For example, the body 80 is not necessarily a T-shape in all embodiments and there may be more or less than the two arms 82A, 82B. Furthermore, the arms are not necessarily arranged on opposite sides of the body 80.

In some embodiments, the system is adapted to have the secondary fluid injected between one or more of the outlets 84 of the manifold 72 and the corresponding fluid spray source. For example, a Venturi tube, such as the Venturi tube 42, may be arranged downstream of one or more of the outlets 84.

The secondary fluid may also be injected at other points in the manifold 72. For example, the manifold 72 may be adapted to have the secondary fluid injected at one or more points along one or more of the arms 82A, 82B or at one or more points along the body 80. In addition or alternatively, the secondary fluid may be injected at one more points along the feed pipe or tubing (not shown) leading to the primary fluid inlet 78. For example, the secondary fluid may be injected at or prior to the manifold 72.

Figure 6:
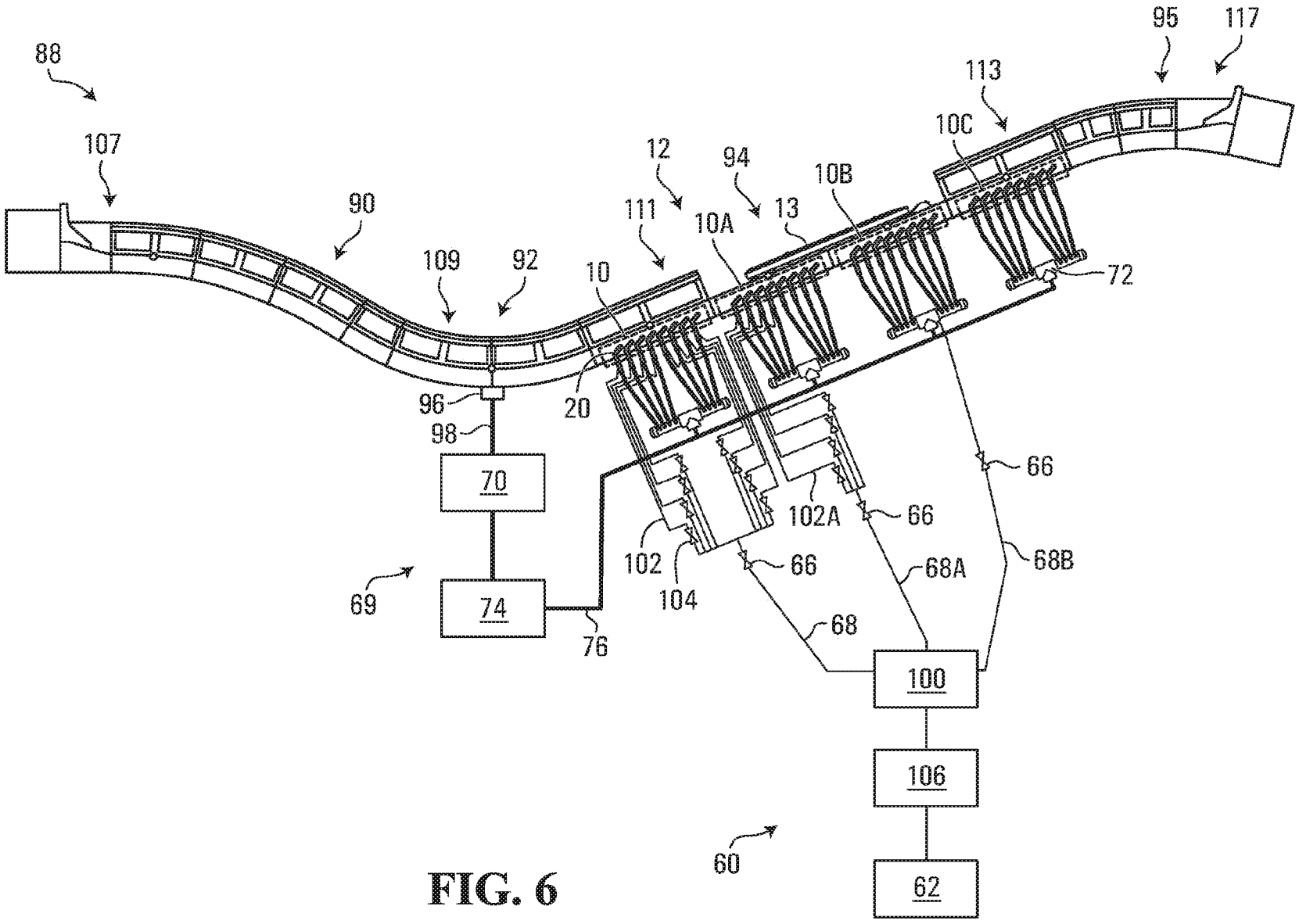
FIG. 6 is a schematic view of a section of an amusement ride which incorporates the system of FIG. 1.

FIG. 6 shows a schematic side view of a zone or section 88 of an amusement ride which incorporates the system 10, the secondary fluid supply system 60 and the primary fluid supply system 69. In this embodiment, the section 88 includes an initial downward portion 90, a transitional concave or valley portion 92, a subsequent upward angled portion 94 and a cresting portion 95. The described portions and curvatures are exemplary only. Numerous other arrangements of upward, downward, horizontal and transitional sections at various angles are also possible.

The channel 12 is shown in FIG. 6 on the upward portion and is depicted without sidewalls 16 so that the vehicle 13 is visible. It will be appreciated that the channel 12 could also form a horizontal section or an upward curved section.

It will be appreciated that the vehicle 13 initially travelling down the downward portion 90 may not have enough moment to travel up the upward portion 94 without the application of an external force, such as the force provided by the flow from the fluid spray sources 20.

Schematically, FIG. 6 further shows multiple possible systems 10, 10A, 10B, and 10C for affecting motion of the vehicle 13, which are located on the upward portion 94. Each system 10, 10A, 10B, and 10C is associated with a corresponding manifold 72 for providing primary fluid which is pumped to the manifold by pump 74 from surge tank 70 via feed line 76 as described in respect of FIG. 4 above.

Surge tank 70 is also fluidly connected to a drain 96 located at a local low point in the valley portion 92. Drain 96 allows primary fluid that collects at the low point to be fed back to surge tank via feed line 98.

Schematically, FIG. 6 also shows a secondary fluid supply system 60 associated with the systems 10, 10A, and 10B. In this embodiment, the supply system includes the compressor 62, and a secondary fluid manifold 100, which may include the pressure regulator 64. The manifold 100 may be any suitable manifold that allows distribution of the secondary fluid to each of the systems 10, 10A, and 10B, as desired.

For example, the manifold 100 for the secondary fluid may include one or more valves, a pressure regulator to regulate the pressure coming into the manifold, and/or a series of regulator(s) to regulate the pressure of the secondary fluid being supplied to different portions of the section 88. In some embodiments, all the sub-branches 102 may be supplied the secondary fluid at the same pressure. In some embodiments, one or more spray sources or groups of spray sources, e.g. one or more systems 10, 10A, 10B, and 10C, may be supplied with secondary fluid at different pressures from the other spray sources or groups of spray sources. In some embodiments secondary fluid may also simply be injected into the primary fluid manifold 72 or at some point before primary fluid enters the manifold 72.

The one-way valve 66 may be positioned in the main feed line 68 between the manifold 100 and each of the systems 10, 10A, and 10B to control flow of the secondary fluid to the fluid spray sources as discussed in respect of FIG. 4.

As seen schematically, each of the systems 10, 10A, and 10B is adapted differently and has a different arrangement for the injection of the secondary fluid. For the system 10, the feed line 68 from the manifold 100 branches off into sub-branches 102, one sub-branch for each spray source 20.

Thus, the system 10 is capable of having the secondary fluid injected for each of the fluid spray source, e.g. directly or via a constriction in a Venturi tube or other fitting.

For the system 10A, the feed line 68A from the manifold 100 branches off into sub-branches 102A, one sub-branch for each of the first four spray sources. The remaining spray sources are not adapted to have secondary fluid injected.

For the system 10B, the feed line 68B from the manifold 100 feeds secondary fluid directly into the manifold 72.

For the system 10C, secondary fluid is not injected and the spray sources only spray primary fluid.

It is noted that, while not explicitly shown in FIG. 6, the branching into sub-branches 102 may occur via a further manifold or other suitable arrangement.

In the present embodiment, there is one sub-branch for each of plurality of fluid spray sources, as shown schematically for the system 10. However, in other embodiments, there may be fewer sub-branches than fluid spray sources; for example, if secondary fluid is only injected for some, but not all, of the fluid spray sources.

In some embodiments, it may be desirable to inject the secondary fluid at different injection pressures throughout the system. In such embodiments, there may be additional pressure regulators or other means for regulating pressure to control the injection pressures at various injection sites in the system.

Furthermore, it is to be understood that not all systems 10, 10A, 10B, and 10C are necessarily supplied with secondary fluid.

Additional controllable valves 104 may be positioned in each sub-branch 102. Thus, while the one-way valve 66 allows one to control the supply of the secondary fluid to the entire system 10, each of valves 104 may be selectively opened or closed to control the supply of the secondary fluid to each individual fluid spray source or pair of fluid spray sources, as desired.

In some embodiments where the secondary fluid is a gas, such as air, the secondary fluid supply system 60 may also include a dryer 106 which is positioned in the stream of the secondary fluid between the compressor 62 and the manifold 100. The dryer 106 may aid in ensuring that clean, dry gas is supplied for injection. The dryer 106 may also aid in protecting components of the secondary fluid supply system 60 that are damaged by moisture. Similarly, the dryer 106 may aid in helping to protect the compressor 62 from any moisture. It is understood that, where the primary fluid is a gas, an air dryer may also be included in the primary fluid supply system 69.

In some embodiments, secondary fluid is constantly being injected during operation of section 88 and only turned off once section 88 is no longer in use, for example at the end of a business day or for maintenance.

In some embodiments, sensors may be provided along the section 88 to record and transmit information concerning the vehicle 13 as it travels along section 88, which may aid in selectively controlling injection of the secondary fluid. In this embodiment, an entry sensor 107 is provided at an entry point of the section 88 and additional sensors, 109, 111, 113, 115 and 117 may be placed at various locations along the section 88, as desired. The sensors 107, 109, 111, 113, 115 and 117 may measure various parameters or characteristics of a participant or the vehicle 13. For example, in some embodiments, the sensors 107, 109, 111, 113, 115 and 117 may only measure the location or passage of the vehicle 13. In other embodiments, one or more of the sensors 107, 109, 111, 113, 115 and 117 may measure different and/or additional parameters, such as velocity.

The sensors may be configured in different ways to detect the presence, characteristics and/or parameters of the vehicle 13. For example, the sensors may be configured as Radio Frequency Identification (RFID) interrogators that detect one or more RFID tags embedded in the vehicle 13 or carried by one or more of the riders. Thus, for example, the entry sensor 107 may be configured as an RFID interrogator that detects an approaching RFID tag on vehicle 13, thereby signalling to the controller to activate injection of the secondary fluid in respect of one or more fluid spray sources 20.

In some embodiments, one or more of the sensors 107, 109, 111,113, 115 and 117 may be configured as proximity sensors, for example as an infrared proximity detector, to detect the presence or approach of the vehicle 13.

In some embodiments, a positioning system, for example a global positioning system (GPS), may be used to track the vehicle as it travels through the ride. This may be done in real time, feeding the vehicle's position to the controller. The controller in turn is configured to control injection of the secondary fluid as desired based on the vehicle's position.

Figure 7:
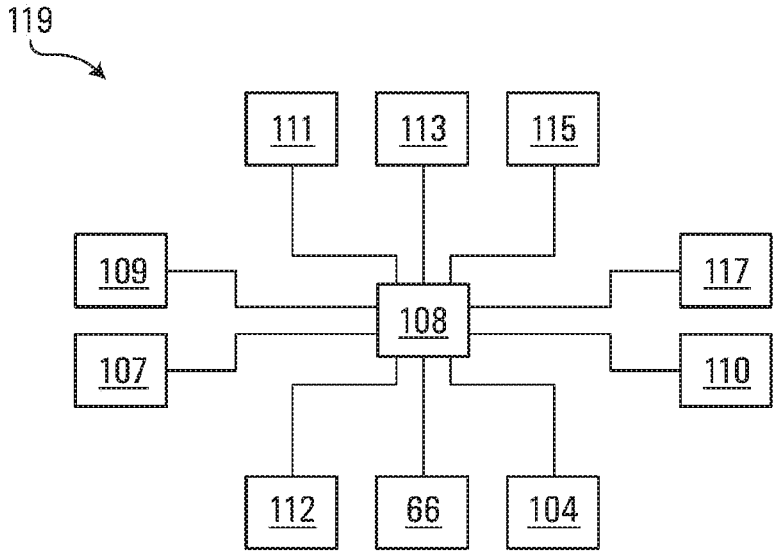
FIG. 7 is a schematic view of one embodiment of a control system of the amusement ride section of FIG. 6.

Referring now to FIG. 7 and FIG. 6, one embodiment of a control system 119 for controlling injection of the secondary fluid will be described. The control system 119 includes a controller 108, such as a programmable logic controller (PLC), adapted to control at least one valve associated with injecting the secondary fluid. The controller 108 is adapted to selectively open and close the valve and permit injection of the secondary fluid.

The controller 108 may be connected to the one-way valve 66 and/or the valves 104. It is to be understood that, while only a single one-way valve 66 and a single valve 104 are depicted in FIG. 7, the controller 108 may be connected to each or some of the one-way valves 66 and/or each or some of the valves 104.

The controller 108 may also be connected to one or more of the sensors 109, 111, 113, and 117, which may provide input to and receive output from the controller 108. A user interface 110 and a storage device 112 may also be connected to the controller 108. The connections of the controller 108 to the other elements is shown schematically only. It will be appreciated that there are numerous connection structures possible, including wireless connections.

While control of the injection of secondary fluid by a controller has been described, other means of controlling injection may also be possible. In some embodiments, injection may be controlled manually, for example by a button or lever or by turning a valve on or off. In some embodiments, electric actuators may be installed/mounted on the valves and controlled by the controller for turning the valves on and off. Such control may be wired or wireless. In some embodiments, electric actuators for controlling the flow of primary fluid or injection of secondary fluid may also be installed in line of the fluid flow, rather than on valves. It is also to be understood that the controller is not always necessary and some embodiments may be implemented without a controller.

In some embodiments, injection may not be selectively controlled and the system may be configured to continuously supply and inject the secondary fluid.

Figures 8A, 8B, 8C:
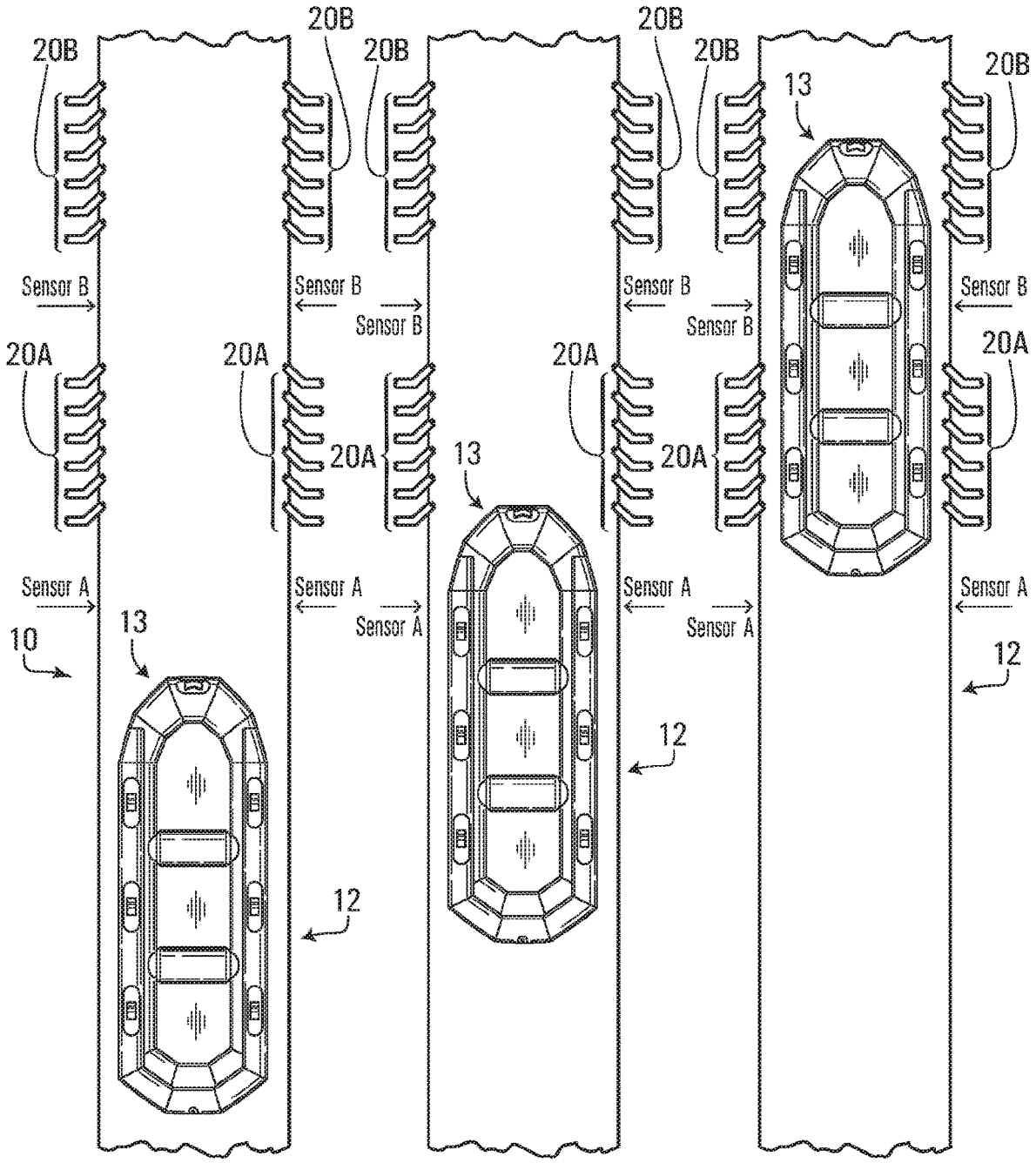
FIGS. 8A, 8B, and 8C are schematic top views of the system of FIG. 1 with the vehicle shown in three different positions.

With reference to FIGS. 8A to 8C, one embodiment of using the control system 119 to control injection of the secondary fluid will be described. It is noted that the following description refers to sensors A and B for simplicity. However, it is understood that the sensors A and B may be two of the sensors 109, 111, 113, 115 and 117.

Furthermore, it is noted that the channel 12 and spray sources 20A and 20B are depicted schematically to facilitate understanding. It will be understood that the vehicle 13 shown in FIGS. 8A to 8C may be travelling a section of a ride as shown and described with reference to FIG. 1.

FIGS. 8A to 8C show the vehicle 13 in three different locations as it travels along the channel 12. In the first position, shown in FIG. 8A, which is equivalent, for example, to the valley portion 92 in FIG. 6, the vehicle 13 has not yet reached the sensors A. The control system 119 has not detected the vehicle 13 and secondary fluid is not being injected such that the spray sources 20, which are split into 20A, 20B (i.e. before and after the sensors B) are spraying primary fluid only at a relatively low pressure or not at all.

In FIG. 8B, the front end 22 of the vehicle 13 is just passing the sensors A. When this happens, the sensors A detect the presence of the vehicle 13. The information is transmitted to the controller 108. The controller 108 in turn activates at least one valve associated with the injection of the secondary fluid. For example, the controller activates the one way valve 66 to permit injection of the secondary fluid. If the valves 104 are present, the controller 108 may activate one or more of the valves 104 in addition to the one-way valve 66 to permit injection of the secondary fluid. The mixture of primary and secondary fluids sprayed out through the spray sources 20A, which may be a mixture of water and air, impacts in the recesses 34 as described with reference to FIG. 1. The force imparted by the flow from the spray sources 20A is sufficient to aid, boost and/or accelerate the vehicle 13 up the upward portion 94, as shown in FIG. 6. In the position of FIG. 8B, the vehicle 13 has not yet reached the sensors B and thus secondary fluid is not yet being injected for the spray sources 20B.

In FIG. 8C, the front end 22 of the vehicle 13 has passed the sensors B. When this happens, the sensors B detect the presence of the vehicle 13. The information is transmitted to the controller 108. The controller 108 opens the valves associated with injection of the secondary fluid for the spray sources 20B. The mixture of primary and secondary fluids sprayed out through the spray sources 20B also impacts in the recesses 34 as described with reference to FIG. 1. The force imparted by the flow from the spray sources 20B may then aid, boost and/or accelerate the vehicle 13 up the upward portion 94.

It is to be understood that the sensors A and B may be located at different locations in the ride or in the section 88. For example, the sensors A may be located prior to the valley portion 92, along the valley portion 92 and/or on the upward portion 94.

The control of the injection of the secondary fluid may also be combined with control of the flow of the primary fluid. For example, detection of the vehicle 13 by the sensors A may cause injection of the secondary fluid and an increase in the flow rate of the primary fluid, either simultaneously or at different times. Similarly, detection of the vehicle 13 by the sensors B may may cause injection of the secondary fluid to cease and a decrease in the flow rate of the primary fluid, either simultaneously or at different times. Different sensors may be employed at different locations to control the primary fluid flow rate and injection of the secondary fluid, or the same sensors may be used to control both.

In some embodiments, the flow rate of the primary fluid may be between 0 and 20 USGPM before the vehicle 13 is detected.

In some embodiments, the spray sources 20A, 20B will provide sufficient force to boost and/or accelerate the vehicle 13 up the upward portion 94 and onto the next portion of the section 88. In other embodiments, the upward portion 94 may contain further sensors and associated spray sources in systems 10, 10A, 10B, and 10C to provide added force.

In some embodiments, the controller 108 may be programmed to inject secondary fluid for a defined length of time. In some embodiments, the control system 119 and the controller 108 may be adapted to close one or more valves associated with injection of the secondary fluid in response to the vehicle 13 leaving a zone of the section 88, as detected by additional sensors, for example the sensor 117.

It will be appreciated that the same progression as shown in FIGS. 8A to 8C may occur if the portion of the channel 12 is horizontal. In such cases, during injection of the secondary fluid, the force from flow would be sufficient to accelerate the vehicle along the channel 12.

In some embodiments, the sensors may be omitted and the injection of the secondary fluid may occur over a defined period of time after a vehicle has commenced the ride. It will be appreciated that numerous other control arrangements are also possible.

Using injection of a secondary fluid may allow the force generated by the fluid spray sources 20 to be increased faster than if other means were used to increase the force, for example by using a pump to increase the pressure of the primary fluid. Similarly, the force generated by the fluid spray sources 20 may be reduced more rapidly by ceasing injection of the secondary fluid than if other means were used to decrease the force, for example by reducing power to the pump of the primary fluid. This may reduce energy waste by allowing the increased force to be generated as close as possible to or only during the time when the increased force is needed or desired. In some embodiments, the controller may be configured to time or control injection of the secondary fluid so as to reduce energy waste and/or increase energy efficiency of the system.

Increasing the force generated by the fluid spray sources using injection of the secondary fluid may be desirable in certain ride configurations, for example in ride configurations where short response times are required or desirable. As such, using injection of the secondary fluid to increase the force generated by the fluid spray sources may be desirable when the fluid spray sources are required to provide increased force on demand.

Injection of the secondary fluid may also be used to create sequences or patterns in the increase of force generated by the fluid spray sources. For example, it may be desirable to have individual or groups of fluid spray sources generate increased force sequentially, with time intervals in between. For example, in some embodiments, the controller may be configured to selectively open and close corresponding valves to permit injection of the secondary fluid such that the force is increased in fluid spray sources one after the other.

Other sequences or series may be possible, as well. For example, alternatingly increasing the force in opposing fluid spray sources on either side of the vehicle may allow one to cause the vehicle to spin, or to be "jostled", or moved in the channel.

Thus, in some embodiments, more precise control of the vehicle's movement may be possible by using injection of secondary fluid to increase the force generated by the fluid spray sources.

It is also to be understood that the sequence or pattern or manner in which the force generated by the fluid spray sources is increased using injection of secondary fluid is not necessarily the same for every vehicle. In some embodiments, it may be desirable to have one or no type of pattern or sequence of injection for a first vehicle but then a different or no pattern or sequence of injection for a second vehicle. The controller may be configured accordingly before the vehicle begins travelling on the ride or there may be a triggering event during the ride that alters the pattern or presence of injection of secondary fluid for the first and/or second vehicle. Alternatively, or in addition, the pattern or presence of injection may vary from vehicle to vehicle, either in a pre-determined (e.g. pre-programmed) or random manner, in order to provide a different, unpredictable and/or unexpected ride experience to one or more riders of the vehicles.

It will also be understood that injection of the secondary fluid may be used in combination with other means to increase the force generated by the fluid spray sources, for example a pump. In some embodiments, injection of the secondary fluid may be used to provide the initial force increase when desired, while allowing time for the pump to increase the pressure of the primary fluid. In conjunction with the increase in pressure from the pump, the injection of the secondary fluid may be reduced or eliminated. In some embodiments, the controller may be configured to control both the injection of the secondary fluid and a pump for the primary fluid to ensure that the force generated by the fluid spray sources stays within a predetermined range.

Some patterns or sequences of injection may also be applied in situations other than in the ordinary operation of the ride. For example, in cases where the ride faults, it may be possible to use sequential injection, and thus force application, to recover a vehicle by sending it all the way down the ride or by moving it further along the ride to a point where attendants can remove the vehicle from the ride.

Results of testing of embodiments of the invention will now be described with reference to FIGS. 9 to 12. In particular, testing was conducted for embodiments similar to those described above in reference to FIGS. 2 and 3, which, for ease of understanding, will be referred to in the following as "direct injection" and "Venturi injection", respectively. In the testing, water was used as the primary fluid and air was used as the secondary fluid. Furthermore, the fluid spray sources were configured as nozzles. For each embodiment, air was injected upstream of each nozzle in one pair of nozzles.

Figure 9:
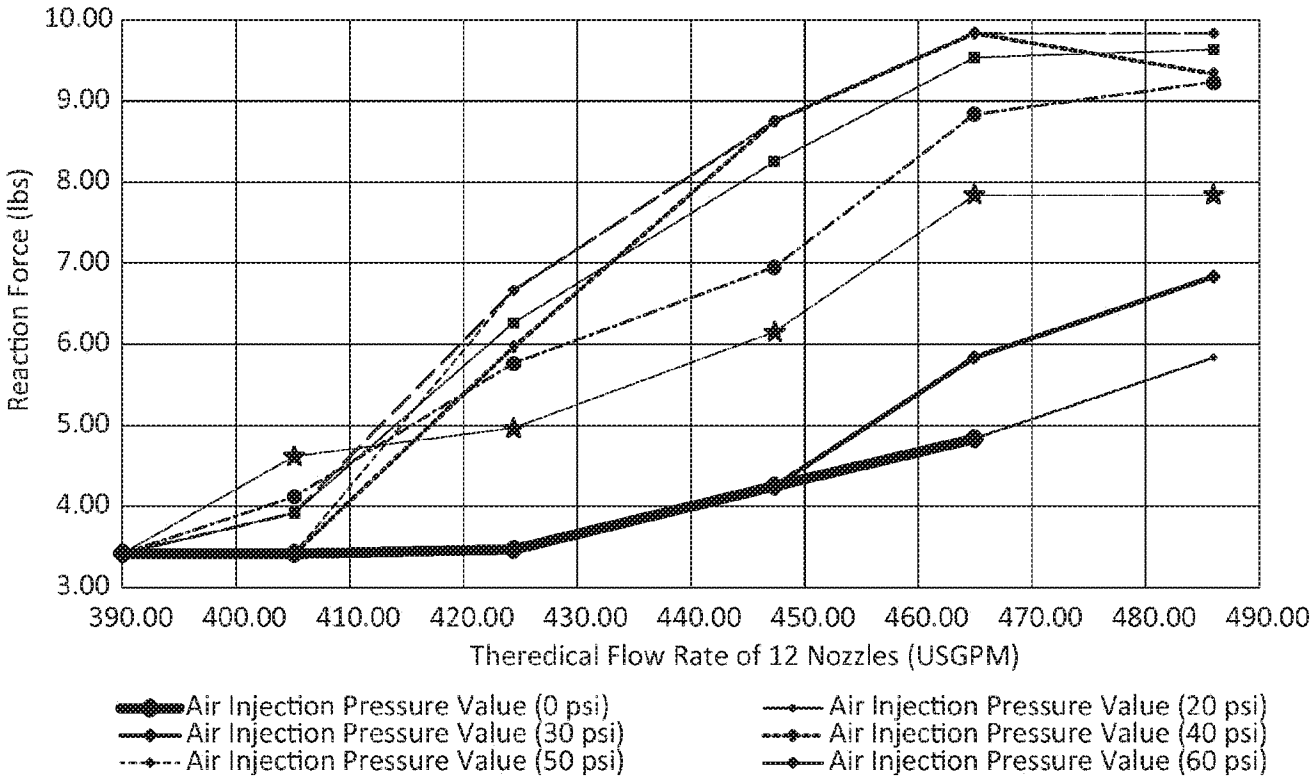
FIG. 9 is a graph showing measured reaction force as a function of flow rate for various air injection pressures where the primary fluid was water and the secondary fluid was air that was directly injected.
Figure 10:
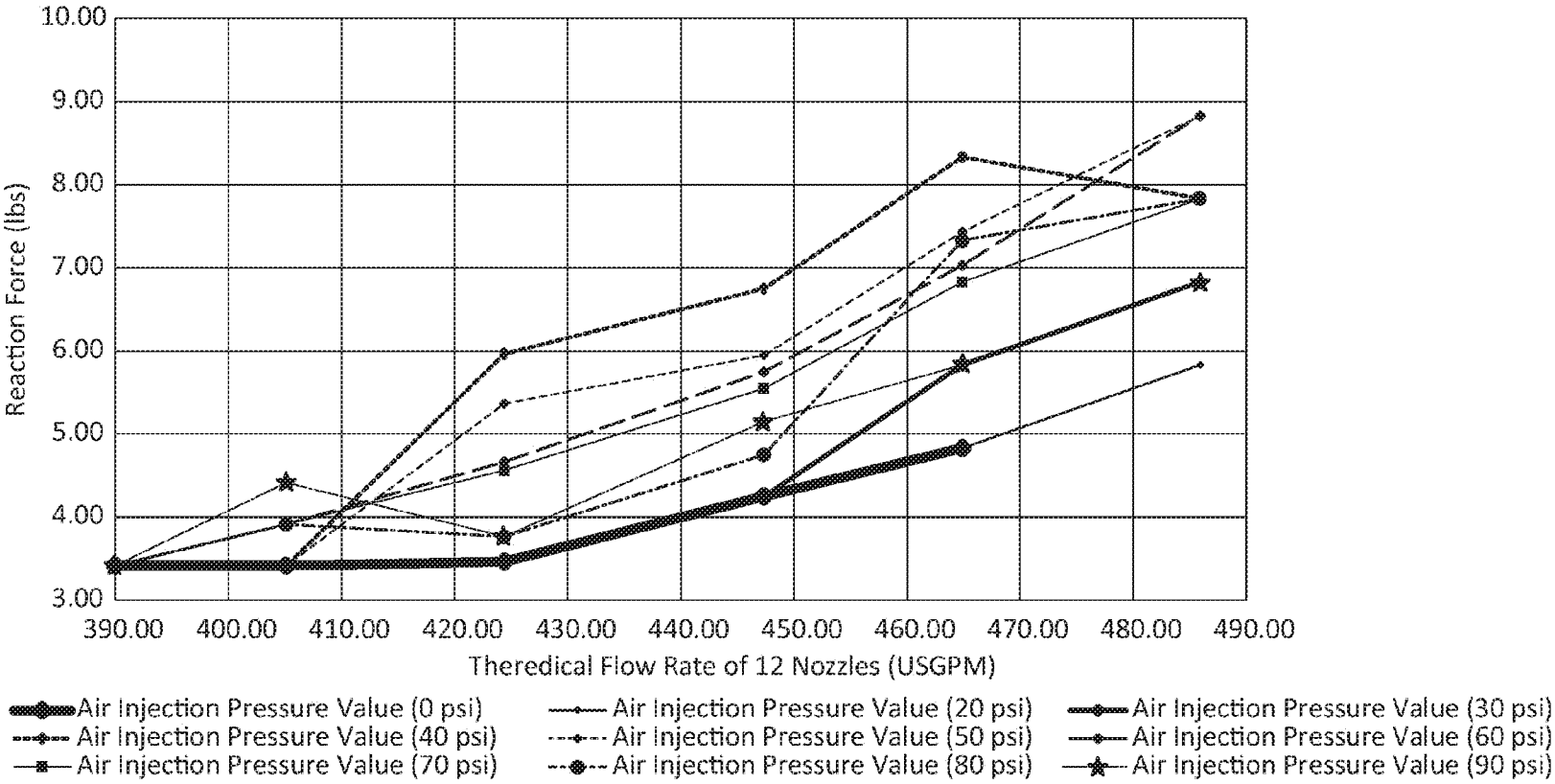
FIG. 10 is a graph showing measured reaction force as a function of flow rate for various air injection pressures where the primary fluid was water and the secondary fluid was air that was injected via a Venturi tube.

A testing rig was set up with which the reaction force of the flow exiting the fluid spray sources was measured. As can be seen in FIGS. 9 and 10, the reaction force applied from a single pair of air injected nozzles was plotted against the total flow rate of water through six nozzle pairs (twelve nozzles total) for various injection pressures of the air.

FIG. 9 shows the results for the direct injection embodiment. FIG. 10 shows the results for the Venturi injection embodiment.

FIG. 9 includes plots for air injection pressures of 0, 20, 30, 40, 50, and 60 psi. FIG. 10 includes plots for air injection pressures of 0, 20, 30, 40, 50, 60, 70, 80 and 90 psi.

Comparing the plots of no air injection (i.e. 0 psi) with the other plots in FIGS. 9 and 10, it can be seen that, in some embodiments, for injection pressure values above 30 psi with a total flow rate of approximately 444 US Gallons Per Minute (USGPM), i.e. approximately 37 USGPM per nozzle, the reaction force is greater than if no air is being injected. It can also be seen, particularly from FIG. 9, that as the total flow rate of water approaches approximately 468 USGPM, i.e. approximately 39 USGPM per nozzle, the effects of injecting air diminish and the slopes of the plots level off or decrease.

In order to aid in determining optimum air injection pressure values for various flow rates of water, the reaction force ratio, i.e. the ratio of the reaction force with air injection to the reaction force without air injection, may be plotted as a function of the total flow rate for different air injection pressures. The plots for the direct injection and Venturi injection embodiments are shown in FIGS. 11 and 12, respectively.

Figure 11:
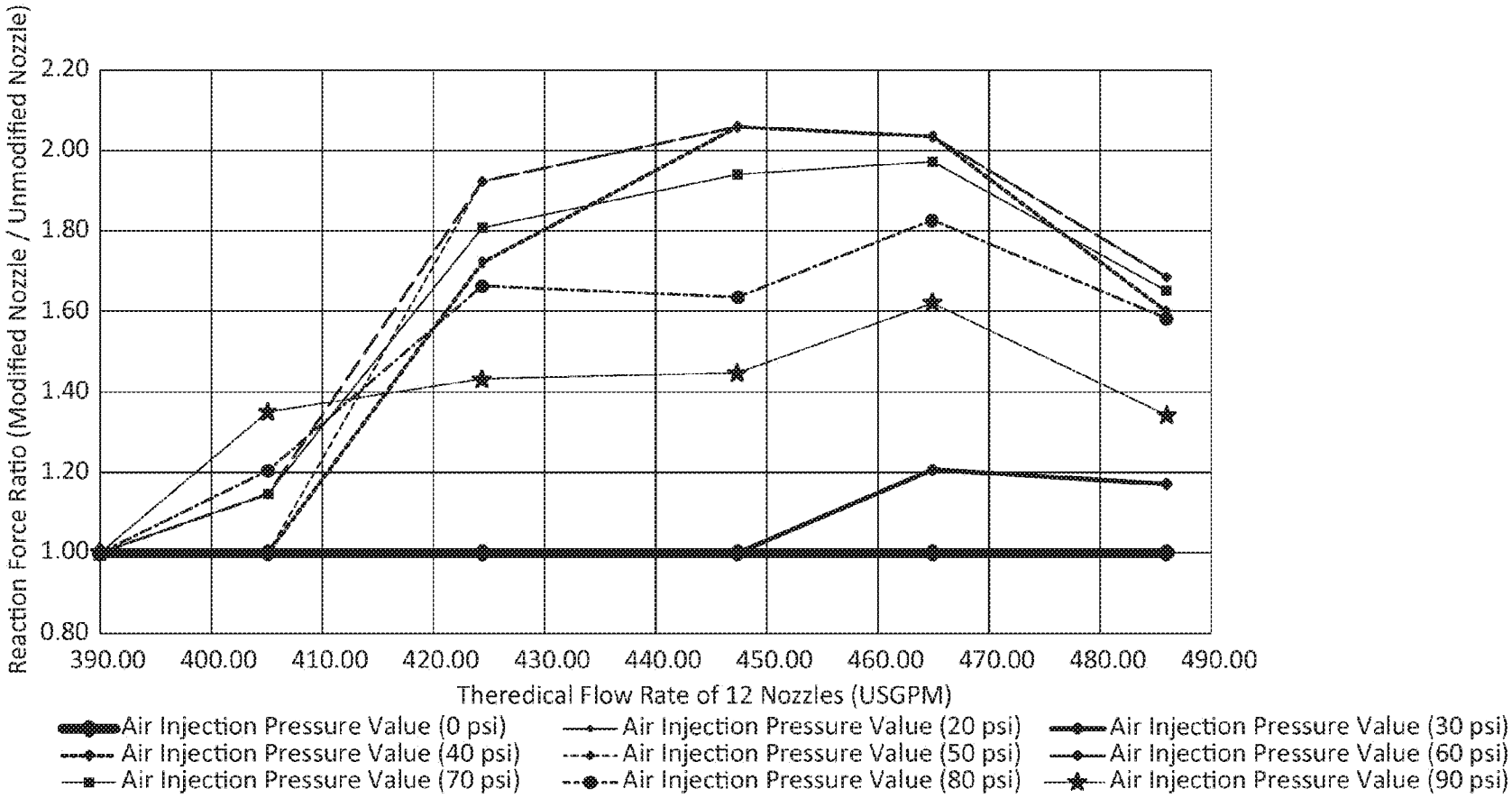
FIG. 11 is a graph showing the reaction force ratio as a function of flow rate for various air injection pressures where air was directly injected.
Figure 12:
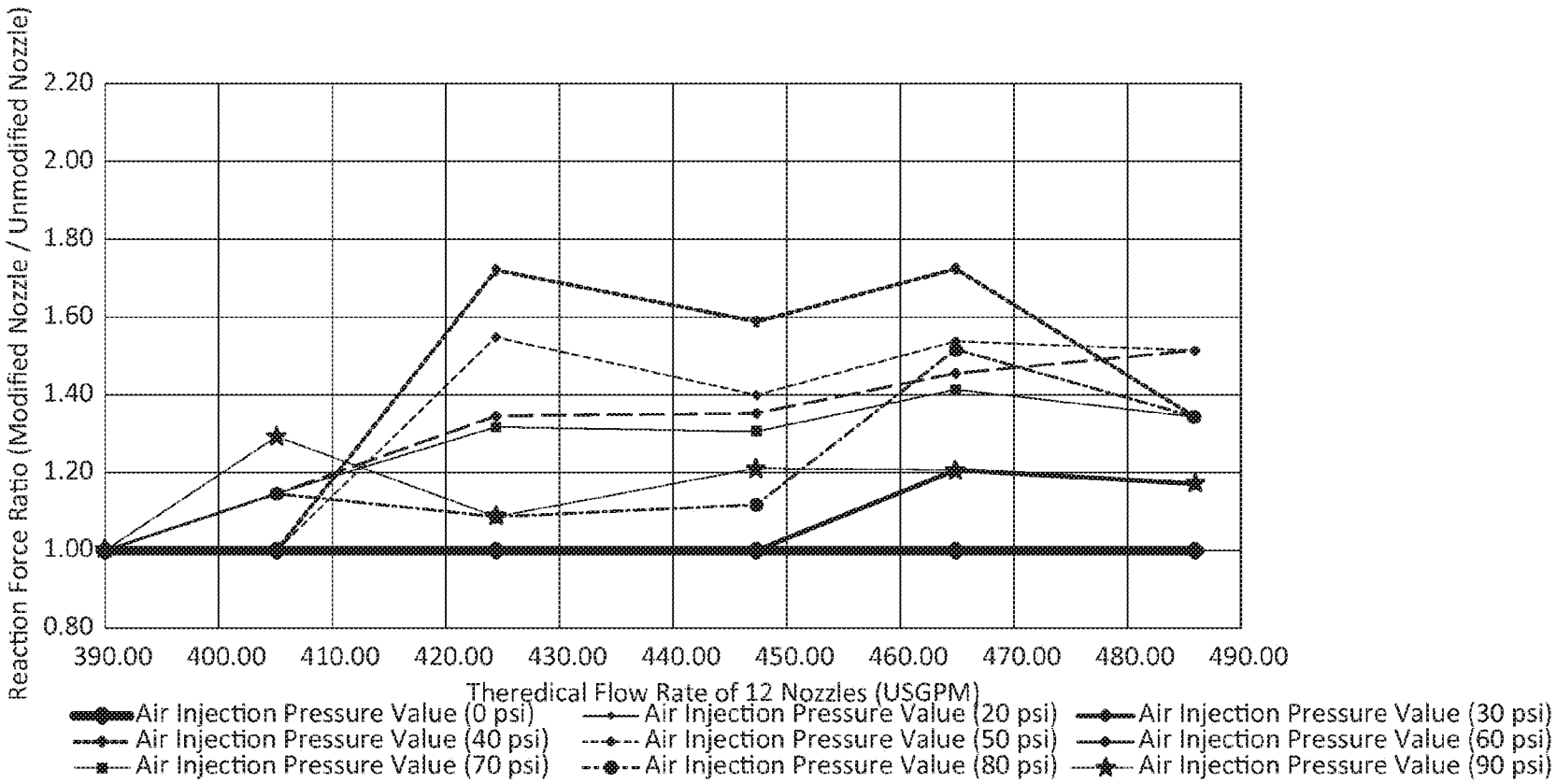
FIG. 12 is a graph showing the reaction force ratio as a function of flow rate for various air injection pressures where air was injected via a Venturi tube.

From FIGS. 11 and 12 it can be seen that, in some embodiments, optimum injection pressure values are in the range of 40 psi to 70 psi as these values produce the largest reaction force ratios. Furthermore, it can be seen that the slopes of the plots are greatest for the range of flow rates between approximately 405 USGPM, i.e. approximately 33.76 USGPM per nozzle, and approximately 424 USGPM, i.e. approximately 35.37 USGPM per nozzle.

What has been described is merely illustrative of the application of principles of embodiments of the present disclosure. Other arrangements and methods can be implemented by those skilled in the art while not departing from spirit and scope of the present disclosure.

We claim:

1. A system for affecting motion of an amusement ride vehicle, the system comprising:

a channel within which the vehicle travels; and a plurality of fluid spray sources positioned to spray at least a primary fluid into the channel, wherein a secondary fluid is injected into the primary fluid to modify at least one of a pressure and a velocity of the primary fluid, causing a mixture of the primary and secondary fluids to exit at least one of the plurality of fluid spray sources, wherein the at least one fluid spray source includes a nozzle having a primary fluid inlet and a primary fluid outlet, the nozzle being adapted to have the secondary fluid injected between the primary fluid inlet and the primary fluid outlet.

2. The system of claim 1, wherein one or both of the primary fluid and the secondary fluid is a liquid, a gas, or a combination thereof.

3. The system of claim 1, wherein the primary fluid is water and the secondary fluid is air.

4. The system of claim 3, further comprising an air dryer to supply dry air as the secondary fluid.

5. The system of claim 3, further comprising an air compressor to supply pressurized air as the secondary fluid.

6. The system of claim 1, further comprising a first sensor adapted to detect when the vehicle enters one of the channel; at least one valve associated with injecting the secondary fluid; and a controller in communication with the first sensor and the at least one valve, the controller being adapted to selectively open the at least one valve and permit injection of the secondary fluid in response to the vehicle entering the zone.

7. The system of claim 6, further comprising a second sensor adapted to detect when the vehicle exits the zone of the channel, the controller being in communication with the second sensor and being adapted to close the at least one valve to cease injection of the secondary fluid in response to the vehicle exiting the zone.

8. The system of claim 1, wherein the channel is upwardly angled and a flow from the plurality of fluid spray sources has a force sufficient to boost the vehicle up the channel.

9. The system of claim 1, wherein the channel is horizontal and a flow from the plurality of fluid spray sources has a force sufficient to accelerate the vehicle along the channel.

10. The system of claim 1, wherein the system is adapted to inject secondary fluid for at least one pair of fluid spray sources, each of the fluid spray sources in the at least one pair being positioned on opposite sides of the channel.

11. The system of claim 1, wherein the secondary fluid is injected at a predetermined injection pressure that is higher than the pressure of the primary fluid.

12. The system of claim 11, wherein the injection pressure is between 40 and 70 psi.

13. The system of claim 12, wherein a volumetric flow rate of the primary fluid through each of the plurality of fluid spray sources is between 33 and 36 US gallons per minute.

14. A method of affecting motion of an amusement ride vehicle comprising:

providing a channel within which the vehicle travels;

positioning a plurality of fluid spray sources to spray at least a primary fluid into the channel;

injecting a secondary fluid into the primary fluid flowing through at least one of the plurality of fluid spray sources to modify at least one of a pressure and a velocity of the primary fluid so that a mixture of the primary and secondary fluids is sprayed with a force sufficient to affect the motion of the vehicle, wherein injecting the secondary fluid comprises injecting the secondary fluid between a primary fluid inlet and a primary fluid outlet of a nozzle of the at least one fluid spray source.

15. The method of claim 14, wherein one or both of the primary fluid and the secondary fluid is a liquid, a gas or a combination thereof.

16. The method of claim 14, wherein the primary fluid is water and the secondary fluid is air.

17. The method of claim 16, further comprising pressurizing the air before injecting the air.

18. The method of claim 16, further comprising drying the air before injecting the air.

19. The method of claim 14, further comprising sensing when the vehicle is entering a zone of the channel before injecting the secondary fluid and injecting the secondary fluid in response to the vehicle entering the zone.

20. The method of claim 19, further comprising sensing when the vehicle is exiting the zone and ceasing injection of the secondary fluid in response to the vehicle exiting the zone.

21. The method of claim 14, wherein the channel is upwardly angled and a force of a flow from the plurality of fluid spray sources boosts the vehicle up the channel.

22. The method of claim 14, wherein the channel is horizontal and a force of a flow from the plurality of fluid spray sources accelerates the vehicle along the channel.

23. The method of claim 14, wherein injecting the secondary fluid comprises injecting the secondary fluid for at least one pair of fluid spray sources, wherein each fluid spray source in the at least one pair is positioned on opposite sides of the channel.

24. The method of claim 14, wherein injecting the secondary fluid comprises injecting the secondary fluid at a predetermined injection pressure that is higher than the pressure of the primary fluid.

25. The method of claim 24, wherein the injection pressure is between 40 and 70 psi.

26. The method of claim 25, wherein a volumetric flow rate of the primary fluid through each of the plurality of fluid spray sources is between 33 and 36 US gallons per minute).

* * * * *